US011497240B1

(12) United States Patent
Ashton

(10) Patent No.: US 11,497,240 B1
(45) Date of Patent: Nov. 15, 2022

(54) SMOKING DEVICE WITH MULTI-USE COMBUSTION CHAMBER

(71) Applicant: Jason Ashton, Watsonville, CA (US)

(72) Inventor: Jason Ashton, Watsonville, CA (US)

( * ) Notice: Subject to any disclaimer, the term of this patent is extended or adjusted under 35 U.S.C. 154(b) by 30 days.

(21) Appl. No.: 17/383,017

(22) Filed: Jul. 22, 2021

(51) Int. Cl.

| | |
|---|---|
| ***A24F 1/16*** | (2006.01) |
| ***A24F 1/28*** | (2006.01) |
| ***A24F 9/00*** | (2006.01) |
| ***A24F 7/02*** | (2006.01) |

(52) U.S. Cl.
CPC ..... *A24F 1/28* (2013.01); *A24F 1/16* (2013.01); *A24F 7/02* (2013.01); *A24F 9/00* (2013.01)

(58) Field of Classification Search
USPC ..... 131/185, 198.2, 226
See application file for complete search history.

(56) References Cited

U.S. PATENT DOCUMENTS

| | | | | |
|---|---|---|---|---|
| 2,761,456 A * | 9/1956 | Pirrone | A24F 13/14 131/175 |
| 5,417,227 A * | 5/1995 | West | A24F 1/00 131/185 |
| D736,994 S * | 8/2015 | Mittersinke | D27/101 |
| 9,220,299 B2 * | 12/2015 | Descamp | A24F 1/00 |
| 10,588,342 B2 * | 3/2020 | Lara, Jr. | A24F 1/16 |
| 2021/0235749 A1 * | 8/2021 | Fischer | A24F 5/10 |

* cited by examiner

*Primary Examiner* — Dionne W. Mayes
(74) *Attorney, Agent, or Firm* — Donald R. Boys; Central Coast Patent Agency LLC

(57) ABSTRACT

A smoking device has a cylindrical combustion chamber with an axis, a longitudinal channel along the length, a mouthpiece engaging a first end of the combustion chamber, an end cap on a second end of the combustion chamber, and an outer shell with a second longitudinal channel, and one or more openings through the outer shell that may be aligned with the longitudinal channel in the combustion chamber such that smokable material in the combustion chamber may be ignited and smoke drawn from the device through the mouthpiece.

14 Claims, 7 Drawing Sheets

SMOKING DEVICE WITH MULTI-USE COMBUSTION CHAMBER

BACKGROUND OF THE INVENTION

1. Field of the Invention

The present invention is in the technical field of apparatus for smoking tobacco, cigarettes or other smokable materials.

2. Description of Related Art

Devices for smoking tobacco and other materials are quite well known in the art, including pipes, water pipes and the like as known in the art. However, there is no such apparatus enabling a user to load a lengthwise chamber with a cigarette, tobacco or other material, and to ignite and smoke the material selectively in a combustion chamber at a plurality of different points along a length of the chamber.

BRIEF SUMMARY OF THE INVENTION

In one embodiment of the invention a smoking device is provided, comprising a cylindrical combustion chamber having an axis, an outside diameter and a first length greater than the outside diameter, with a first longitudinal channel parallel with the axis opening through a wall of the combustion chamber along a portion of the length, a mouthpiece adapted to engage a first end of the cylindrical combustion chamber, the mouthpiece tapered to an outside end with an opening through the mouthpiece into the combustion chamber, a closed cap having a longitudinal through hole, the closed cap adapted to engage a second end of the combustion chamber, and an outer shell having an inside diameter and a second length, with a second longitudinal channel opening through a wall of the outer shell for a portion of the length parallel with the axis, the second longitudinal channel having a width equal to the width of the first longitudinal channel of the combustion chamber, the outer shell also having a plurality of holes through the wall of the outer shell, with centers of the holes positioned on a spiral line wrapping around the outer shell, spacing the holes apart along the length of the outer shell. The outer shell engages the outside diameter of the combustion chamber in a slip fit along the length of the combustion chamber between the mouthpiece and cap, enabling a user to rotate the outer shell on the combustion chamber, wherein with the outer shell positioned rotationally with the combustion chamber with the first and second longitudinal channels aligned the combustion chamber is open to the outside through the aligned longitudinal channels and the user is enabled to load smokable material into the combustion chamber, and wherein the user is enabled to rotate the outer shell to a plurality of rotary positions positioning individual ones of the holes through the outer shell aligned with the first longitudinal channel, such that material may be ignited and smoke may be drawn through the individual holes independently at different positions along the length.

In one embodiment the outer shell has a continuous channel following a spiral path around the wall of the outer shell. Also, in one embodiment the cap and the mouthpiece each have a threaded interface compatible with a threaded interface on ends of the combustion chamber, and the cap and mouthpiece are joined and removed by manipulation of the threaded interfaces. In one embodiment the smoking device further comprises numbers proximate the holes along the spiral path of the outer shell. And in one embodiment the smoking device further comprises lettering along the length of the outer shell.

In one embodiment the outer shell further comprises an embossed or knurled surface. Also, in one embodiment the smoking device further comprises a cover adapted to fit over one end of the smoking device with a pen clip.

In another aspect of the invention a method for consuming smokable material is provided, comprising machining a first longitudinal channel opening through a wall of a combustion chamber along a portion of a length and parallel with an axis of the combustion chamber, engaging an outer shell having an inside diameter of a dimension to form a slip fit with the outside diameter of the combustion chamber over the combustion chamber, the outer shell having a second longitudinal channel opening through a wall of the outer shell for a portion of the length parallel with the axis, the second longitudinal channel having a width equal to the width of the first longitudinal channel of the combustion chamber, the outer shell also having a plurality of holes through a wall of the outer shell, with centers of the holes positioned on a spiral line wrapping around the outer shell, spacing the holes apart along the length of the outer shell, engaging a mouthpiece to one end of the combustion chamber, the mouthpiece open from an outside end into the combustion chamber, engaging a cap to an opposite end of the combustion chamber from the mouthpiece, the cap having a through hole parallel with the axis of the combustion chamber, rotating the outer shell relative to the combustion chamber such that the first and second longitudinal channels are aligned, loading smokable material into the combustion chamber through the aligned longitudinal channels, rotating the outer shell relative to the combustion chamber such that individual ones of the holes along the spiral line are aligned with the first longitudinal channel through the combustion chamber, igniting the smoking material through the holes, and drawing air by the mouthpiece through the holes, conducting smoke through the mouthpiece to the user.

In one embodiment of the method there is a continuous channel following a spiral path around the wall of the outer shell. Also, in one embodiment the holes in the outer shell are along a straight line parallel with the longitudinal channel in the outer shell. In one embodiment the method has a step forming the cap and the mouthpiece each with a counterbore of a diameter to press the cap and the mouthpiece onto the outside diameter of the combustion chamber manually, and to remove same manually. In one embodiment the method comprises a step providing the cap and the mouthpiece each with a threaded interface compatible with a threaded interface on ends of the combustion chamber and joining and removing the cap and mouthpiece by manipulation of the threaded interfaces.

In one embodiment the method further comprises providing numbers proximate the holes along the spiral path of the outer shell. In one embodiment the method further comprises providing lettering along the length of the outer shell. In one embodiment the method further comprises knurling or embossing the outer shell. And in one embodiment the method further comprises joining a cover having a pen clip to one end of the smoking device.

DETAILED DESCRIPTION OF THE INVENTION

Figures 1A, 1B, 1C:
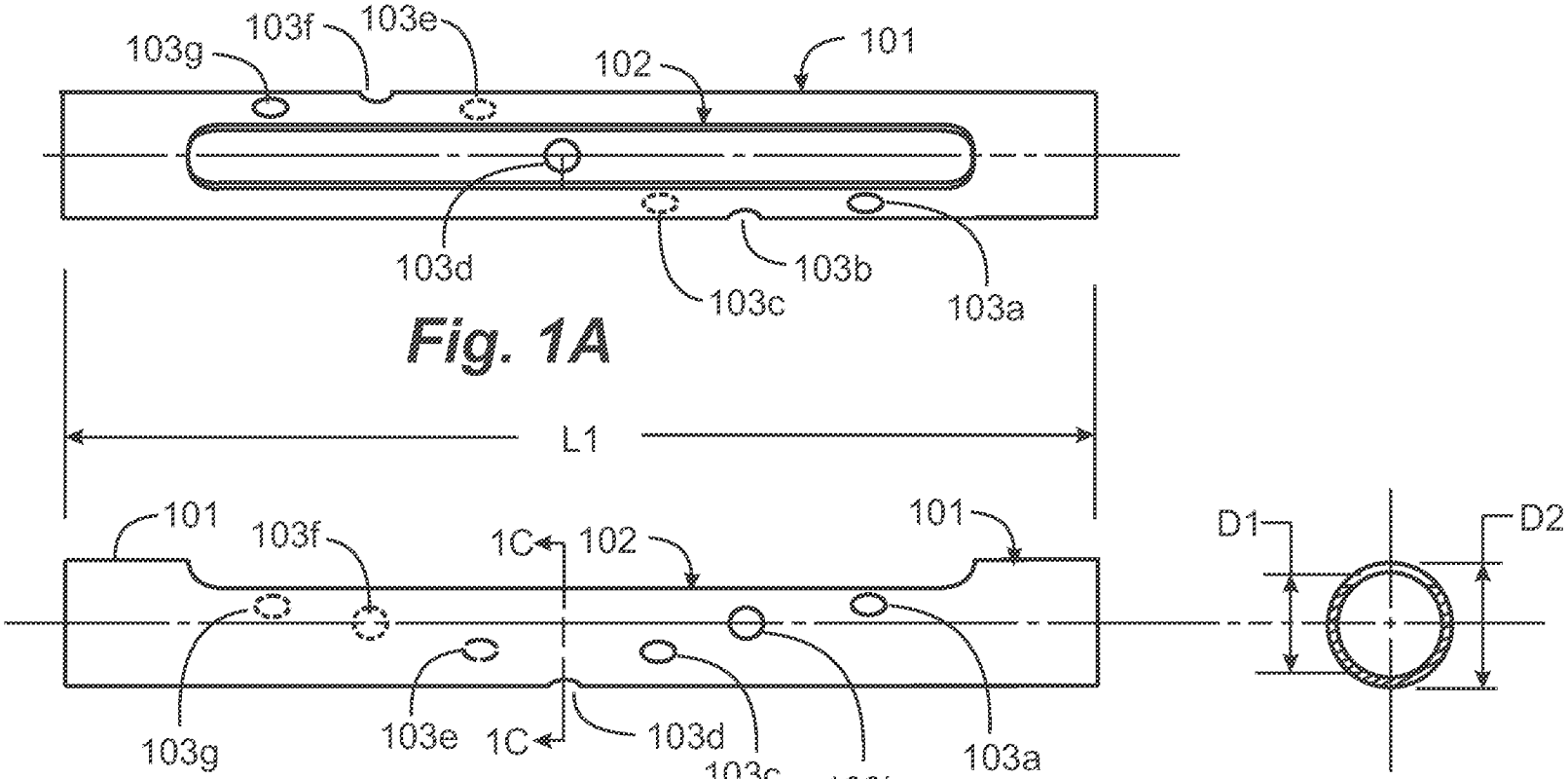
FIG. 1A is a top plan view of an outer shell for an assembly of a smoking device in an embodiment of the present invention.
FIG. 1B is an elevation view of the outer shell of FIG. 1A in an embodiment of the invention.
FIG. 1C is a cross-section of the outer shell taken along section line 1C-1C of FIG. 1B.

FIGS. 1A, 1B and 1C illustrate an outer shell 101 for an assembly of a smoking device in an embodiment of the present invention. FIG. 1A is a top plan view showing outer shell 101 as cylindrical with an overall length L1. The shell is open on both ends, has a lengthwise longitudinal channel cutout 102 for a portion of the length and to a depth of about one fourth of the diameter of the shell, and in one embodiment has a series of through holes 103*a* through 103*g* in this example, the holes following a spiral path around the body of the cylinder as shown, and spaced apart evenly along the length. FIG. 1B is a side elevation view of the outer shell, and FIG. 1C is a cross-section taken along section line 1C-1C of FIG. 1B. FIG. 1C shows outside diameter (OD) and inside diameter (ID) of the outer shell. Outer shell 101 in embodiments of the invention is preferably formed of, aluminum, glass or stainless steel, or any other non-flammable suitable material, as the elements of the smoking device are not to be flammable and must resist temperature of ignited tobacco or other material to be smoked.

Figure 1D:
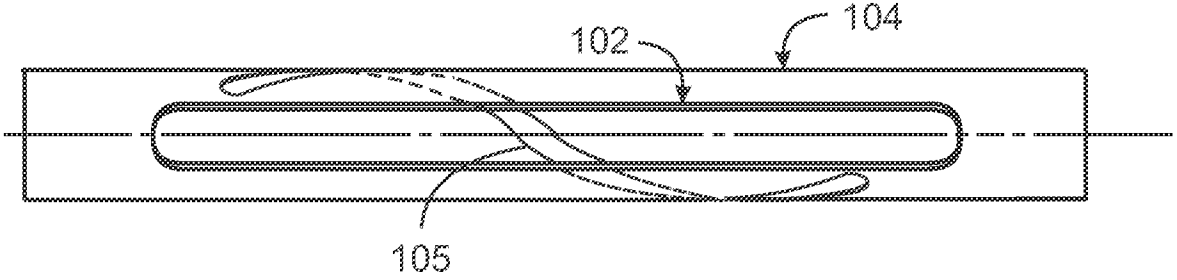
FIG. 1D illustrates an outer shell having a spiral channel.

In an alternative embodiment rather than the series of holes 103*a* through 103*g*, there may be instead a second continuous channel following the spiral path of the holes, and of a width of the diameter of the holes. FIG. 1D is a top view of an outer shell 104 having a spiral channel 105 instead of the holes along a spiral path of FIGS. 1A, 1*b* and 1C.

Figures 2A, 2B:
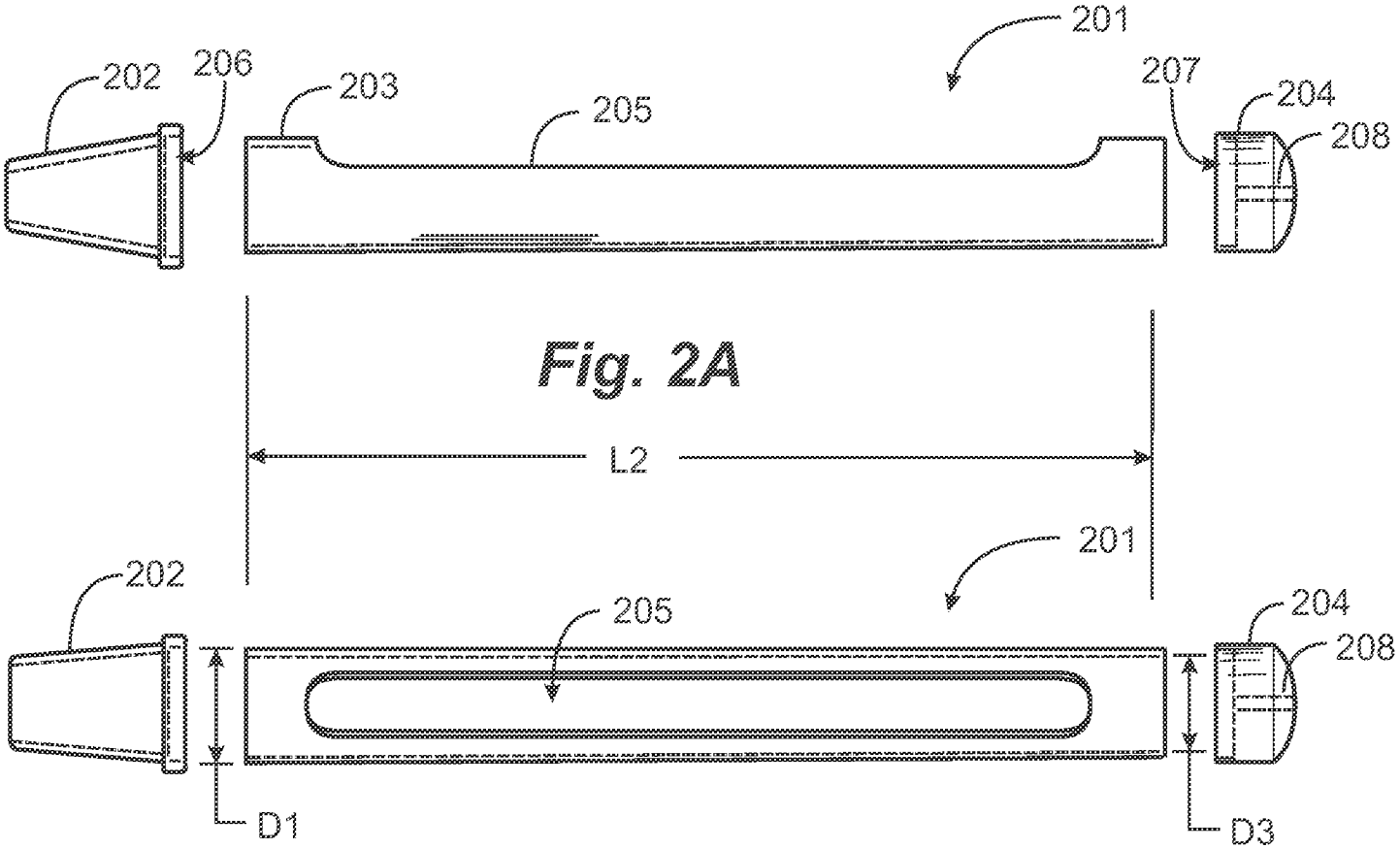
FIG. 2A is an elevation view of a combustion chamber with end pieces in an embodiment of the invention.
FIG. 2B is a top plan view of the combustion chamber of FIG. 2A.

FIGS. 2A and 2B illustrate a combustion chamber and end pieces for the smoking device. FIG. 2A is a side elevation view of combustion chamber 201 for the smoking device, comprising a cylindrica chamber portion 203, a mouthpiece 202 and an end closure 204. Chamber portion 203 has an outside diameter D1 essentially the same as, but just slightly smaller, than inside diameter D1 of outer shell 101. This relationship allows outer shell 101 to be assembled over chamber portion 203, and to be easily rotatable about the chamber portion, as is shown and described in enabling detail below.

Mouthpiece 202 has a counterbore 206 of a diameter to be a mild press fit over the outside diameter D1 of chamber portion 203. End cap 204 has a counterbore 207 to also be a mild press fit over the outside diameter of chamber portion 203. In one embodiment end cap 204 has a through hole 208 in the direction of the axis of the combustion chamber, and in another embodiment there is no through hole.

Chamber portion 203 has a lengthwise cutout 205 along a portion of the length L2 and to a depth of about one quarter of the diameter of the chamber portion, and of a 10 length equal to the link of the similar cutout in outer shell 101. It should be noted that holes 103*a* through 103*g* are only through the wall of outer shell 101, and there are no such holes in chamber portion 203.

Figure 3A:
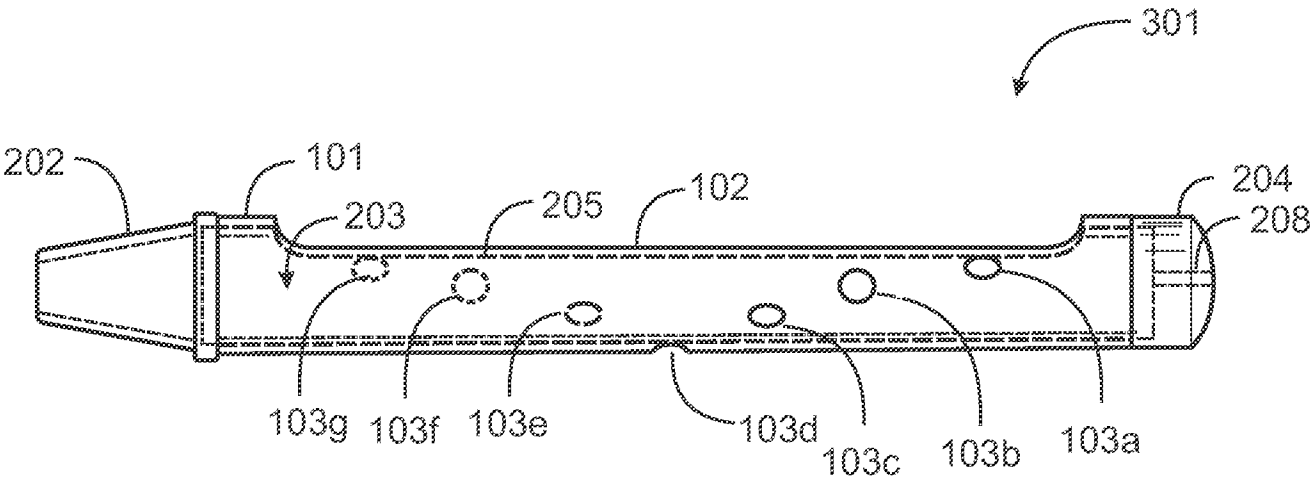
FIG. 3A is an assembly elevation view of a smoking device in an embodiment of the invention comprising parts illustrated in FIGS. 1A, 1B and 1C, and in FIGS. 2A and 2B.

FIG. 3A is an assembly elevation view of a smoking device 301 comprising all of the parts illustrated in FIGS. 1A, 1B and 1C, and in FIGS. 2A and 2B. To make the assembly, with either mouthpiece 202 or cap 204 removed from chamber portion 203, outer shell 101 is engaged over the diameter of the chamber portion, and the cap and mouthpiece are replaced on the ends of the chamber portion. Both the cap and mouthpiece are made for a mild press fit such that they may be engaged and removed rather easily. In some embodiments there may be threaded interfaces for this engagement. The outer shell has an inside diameter such that it may be freely slipped over the outside diameter of the chamber portion and may be freely rotated around the chamber portion once the assembly is accomplished.

In FIG. 3A the chamber portion and the outer shell are positioned rotationally such that the cutouts 102 and 205 are aligned. Holes 103*a* through 103*g* are indicated in FIG. 3A, but in this state none of the holes go through to the inner volume of the chamber portion. In the embodiment implementing a spiral channel in the outer shell, rather than the holes along a spiral path, in the circumstance and relationship of FIGS. 3A and 3B, no paet part of the spiral channel crosses lengthwise channel 205 of the combustion chamber.

Figure 3B:
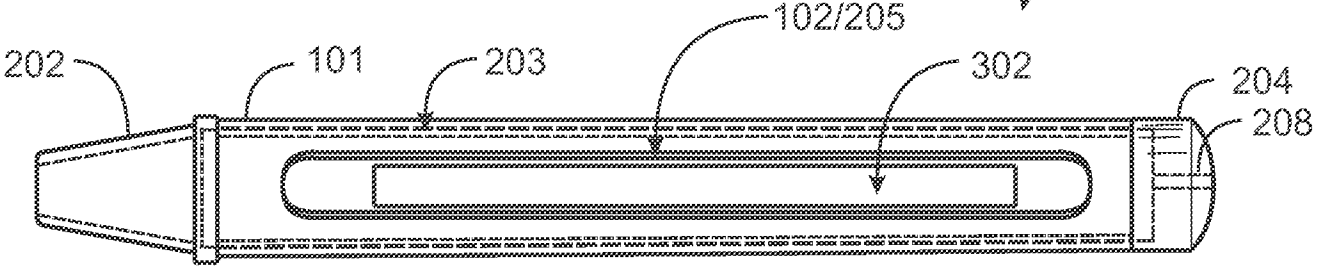
FIG. 3B is the assembly of a smoking device of FIG. 3A, rotated 90 degrees to show a top plan view.

FIG. 3B is the assembly of a smoking device of FIG. 3A, rotated 90 degrees to show a top plan view. It may be seen in this top view that cutouts 102 and 205 are still aligned. Holes 103(*a*-*g*) are not shown in FIG. 3B, nor is the spiral channel in the alternative embodiment. In the state of the assembly shown in FIGS. 3A and 3B the inner volume of the combustion chamber portion 203 is exposed through the aligned cutouts 102 and 105. In this state a user may place a cigarette into the chamber portion, the cigarette aligned longitudinally with the cutouts 102 and 205. Element 302 represents a cigarette placed into the chamber portion.

It should be noted that loading the chamber portion is not limited to a cigarette. A user may load any material to smoke into the chamber portion through the aligned cutouts 102 and 205. Loose tobacco or other loose material to be smoked may be loaded, and powder materials may also be loaded into the chamber portion.

Figure 3C:
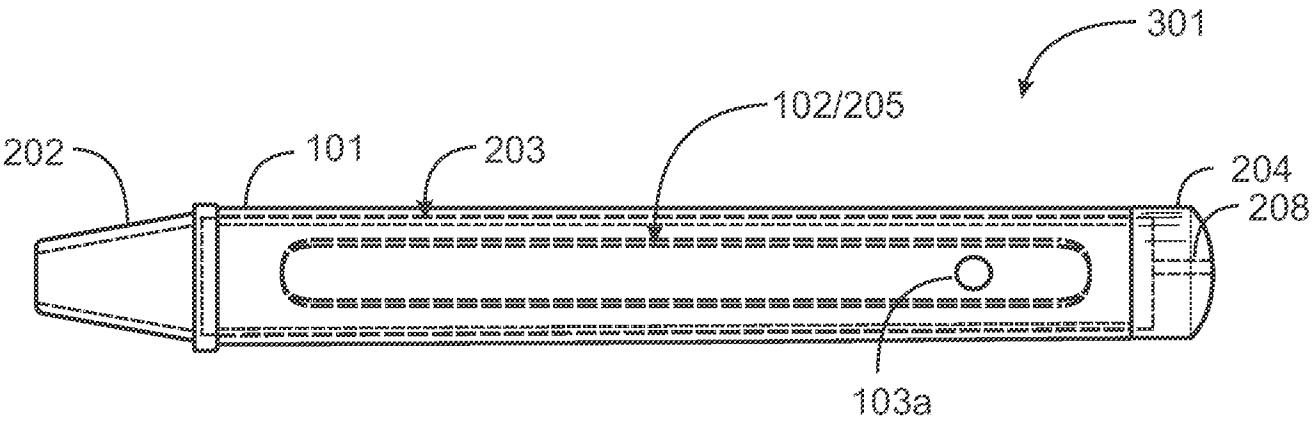
FIG. 3C is a plan view of the assembly of FIGS. 3A and 3B with the outer shell rotated such that a hole is now aligned with the cutout in the combustion chamber portion.

FIG. 3C is a plan view of the assembly of FIGS. 3A and 3B with outer shell 101 rotated such that hole 103*a* is now aligned with cutout 205 in the chamber portion. In this rotational aspect the lengthwise cutouts 102 and 205 in the inner chamber portion and the outer shell are no longer aligned. Hole 103*a* however is now positioned over the cutout 205 in the inner chamber portion. With the inner chamber portion loaded with smokable material one may place the mouth on the mouthpiece and draw air into and through the chamber portion from hole 103*a*. In an embodiment with a hole 208 through the end cap air will be drawn in as well trough hole 208, or a user may block hole 208 with a finger as desired. One may also touch a match or other lighting instrument to hole 103*a* and ignite the smokable material in the inner chamber portion and draw smoke through the length of the chamber portion and out through the mouthpiece.

At some point after ignition and drawing smoke through combustion chamber 201 and mouthpiece 202 a user may rotate outer shell 101 to a rotary position to cut off any draw of air into the inner chamber portion. The ignited material may extinguish under this circumstance.

Figure 3D:
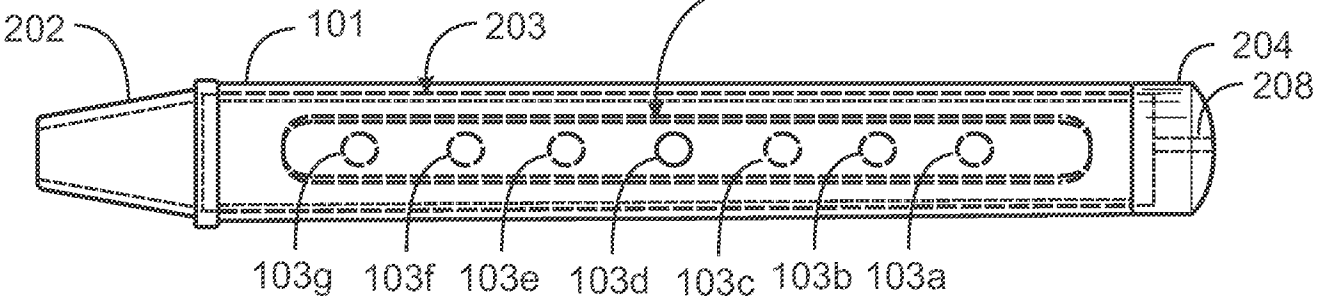
FIG. 3D is a plan view of the assembly of FIGS. 3A and 3B with the outer shell rotated such that a different hole is now aligned with the cutout in the chamber portion.

FIG. 3D illustrates the assembly of the outer shell and the inner chamber rotated relatively such that hole 103*d* is now aligned with cutout 205 of the inner chamber portion, and now consumable material may be ignited at the position of hole 103*d*, which, it will be noted, is about midway on the length of the assembly, and air may be drawn in through hole 103*d* and smoke may be drawn down the length of the inner chamber and through the mouthpiece.

The holes 103*a* through 103*g* that are not aligned with cutout 205 are shown in FIG. 3D in dotted outline to indicate that these are positions where other holes may be aligned and used by rotation of the outer shell relative to the inner chamber portion. A user may thusly consume material selectively along the length of the inner chamber portion.

In other embodiments holes may be implemented through the outer shell in patterns other than the spiral pattern shown and described. For example, in one embodiment the holes may be implemented along a straight line parallel with the longitudinal channel, in which case all the holes may be aligned with the longitudinal channel in the combustion chamber, in the pattern shown in FIG. 3*d*, and the user may choose which hole or holes to use.

Figure 3E:
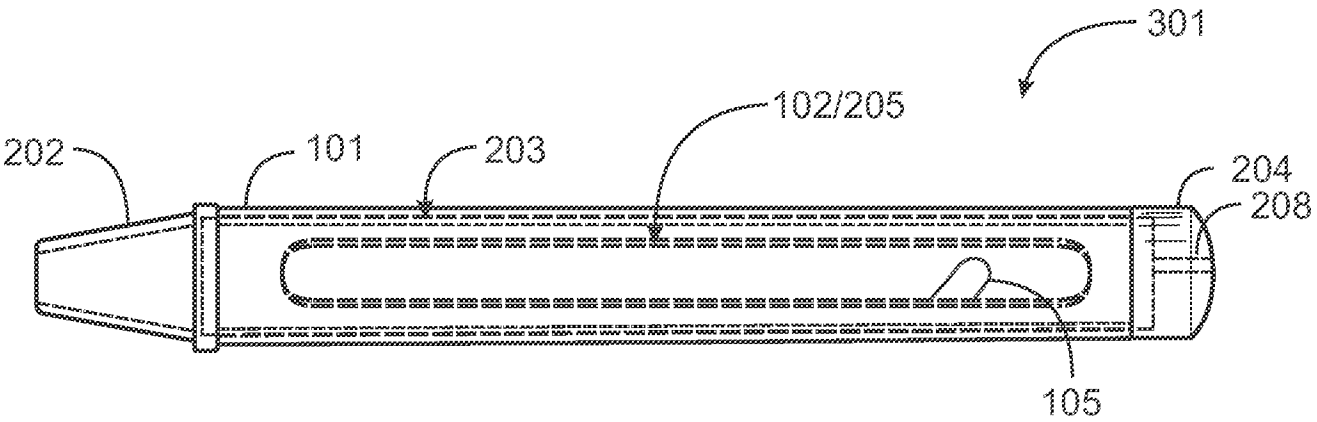
FIG. 3E is a plan view of an assembly of an outer shell with a spiral channel over a combustion chamber.
Figure 3F:
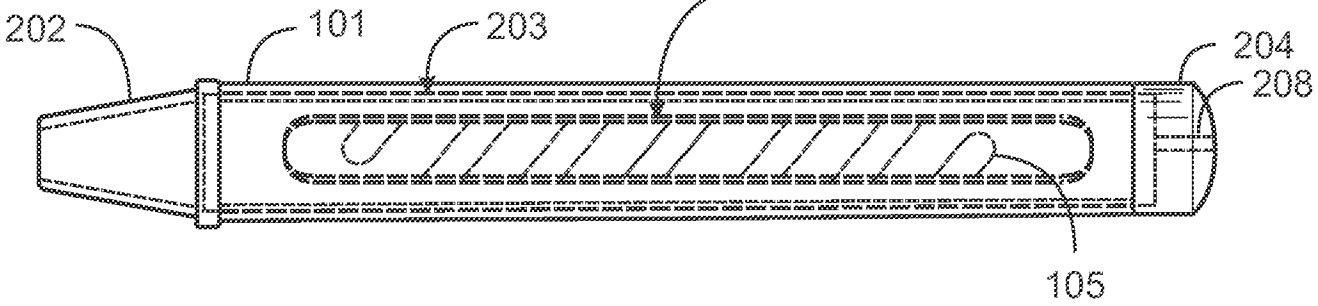
FIG. 3F is the plan view of FIG. 3E showing alternative positions of overlap of the spiral channel with the straight channel of the combustion chamber.

FIGS. 3E and 3F illustrate the circumstance in the alternative embodiment wherein a spiral channel is implemented in the outer shell. In FIG. 3E the outer shell is rotated to the position apparent in FIG. 3C, and a portion of spiral channel 105 at an end of the spiral channel overlaps channel 205 providing an opening into the inner volume of the combustion chamber. FIG. 3F illustrates a circumstance wherein the outer shell is rotated so that the mid portion of the spiral channel, shown in unbroken line, overlaps channel 205 creating a passage through to the inner volume of the combustion chamber. Other positions of overlap creating passage into the combustion chamber are shown in dotted lines. The skilled person will understand that, with the spiral channel in the outer shell 101, that an overlap creating an opening may be implemented at any position of rotation of the outer shell 101, as it is no longer necessary to position a hole in the outer shell with the channel in the combustion chamber.

Figure 4:
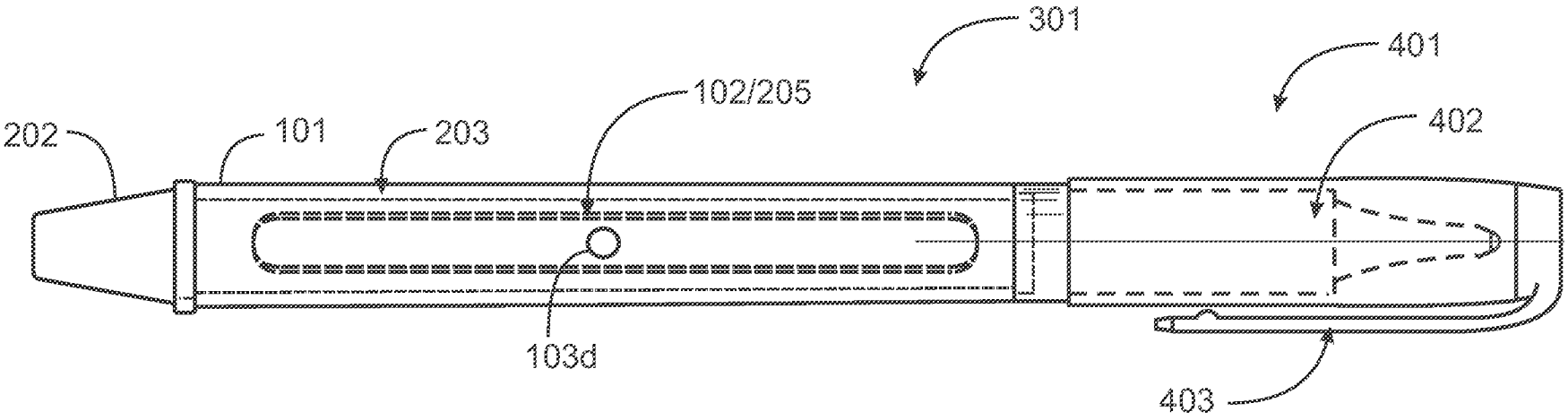
FIG. 4 is a side elevation view of the smoking device of FIGS. 3A, B, C and D with additionally a pen clip.

FIG. 4 is a side elevation view of the smoking device of FIGS. 3A, B, C and D with additionally a pen clip 401, such that a user might carry the smoking device in shirt, vest or jacket pocket by a clip 403. In some embodiments there may be a working pen tip 402, and in others not. In one embodiment the pen clip 401 may be implemented on an opposite end of the smoking device, and may, in that embodiment, cover the mouthpiece 202.

The skilled person will understand that the embodiments described above are entirely exemplary, and not limiting to the scope of the invention. many variations may be made in the materials, dimensions and the like within the scope of the invention. The scope is limited only by the claims.

The invention claimed is:

1. A smoking device, comprising:

a cylindrical combustion chamber having an axis, an outside diameter and a first length greater than the outside diameter, with a first longitudinal channel parallel with the axis opening through a wall of the combustion chamber along a portion of the length;

a mouthpiece adapted to engage a first end of the cylindrical combustion chamber, the mouthpiece tapered to an outside end with an opening through the mouthpiece into the combustion chamber;

a closed cap having a longitudinal through hole, the closed cap adapted to engage a second end of the combustion chamber; and an outer shell having an inside diameter and a second length, with a second longitudinal channel opening through a wall of the outer shell for a portion of the length parallel with the axis, the second longitudinal channel having a width equal to the width of the first longitudinal channel of the combustion chamber, the outer shell also having a plurality of holes through the wall of the outer shell, with centers of the holes positioned on a spiral line wrapping around the outer shell, spacing the holes apart along the length of the outer shell;

wherein the outer shell engages the outside diameter of the combustion chamber in a slip fit along the length of the combustion chamber between the mouthpiece and cap, thereby positioning the outer shell with the combustion chamber enabling a user to rotate the outer shell on the combustion chamber;

wherein the first and second longitudinal channels are aligned such that the combustion chamber is open to the outside through the aligned longitudinal channels enabling the user to load smokable material into the combustion chamber; and wherein the user is enabled to rotate the outer shell to a plurality of rotary positions positioning individual ones of the holes through the outer shell aligned with the first longitudinal channel, such that material may be ignited and smoke may be drawn through the individual holes independently at different positions along the length.

2. The smoking device of claim 1 wherein the cap and the mouthpiece each have a counterbore of a diameter to press the cap and the mouthpiece onto the outside diameter of the combustion chamber manually, and to remove same manually.

3. The smoking device of claim 1 wherein the cap and the mouthpiece each have a threaded interface compatible with a threaded interface on ends of the combustion chamber, and the cap and mouthpiece are joined and removed by manipulation of the threaded interfaces.

4. The smoking device of claim 1 further comprising numbers proximate the holes along the spiral line of the outer shell.

5. The smoking device of claim 1 further comprising lettering along the length of the outer shell.

6. The smoking device of claim 1 wherein the outer shell further comprises an embossed or knurled surface.

7. The smoking device of claim 1 further comprising a cover adapted to fit over one end of the smoking device with a pen clip.

8. A method for consuming smokable material, comprising:

machining a first longitudinal channel opening through a wall of a combustion chamber along a portion of a length and parallel with an axis of the combustion chamber;

engaging an outer shell having an inside diameter of a dimension to form a slip fit with the outside diameter of the combustion chamber over the combustion chamber, the outer shell having a second longitudinal channel opening through a wall of the outer shell for a portion of the length parallel with the axis, the second longitudinal channel having a width equal to the width of the first longitudinal channel of the combustion chamber, the outer shell also having a plurality of holes through a wall of the outer shell, with centers of the holes positioned on a spiral line wrapping around the outer shell, spacing the holes apart along the length of the outer shell;

engaging a mouthpiece to one end of the combustion chamber, the mouthpiece open from an outside end into the combustion chamber;

engaging a cap to an opposite end of the combustion chamber from the mouthpiece, the cap having a through hole parallel with the axis of the combustion chamber;

rotating the outer shell relative to the combustion chamber such that the first and second longitudinal channels are aligned;

loading smokable material into the combustion chamber through the aligned longitudinal channels;

rotating the outer shell relative to the combustion chamber such that individual ones of the holes along the spiral line are aligned with the first longitudinal channel through the combustion chamber;

igniting the smoking material through the holes; and drawing air by the mouthpiece through the holes, conducting smoke through the mouthpiece to the user.

9. The method of claim 8 comprising forming the cap and the mouthpiece each with a counterbore of a diameter to press the cap and the mouthpiece onto the outside diameter of the combustion chamber manually, and to remove same manually.

10. The method of claim 8 comprising providing the cap and the mouthpiece each with a threaded interface compatible with a threaded interface on ends of the combustion chamber and joining and removing the cap and mouthpiece by manipulation of the threaded interfaces.

11. The method of claim 8 further comprising providing numbers proximate the holes along the spiral path of the outer shell.

12. The method of claim 8 further comprising providing lettering along the length of the outer shell.

13. The method of claim 8 further comprising knurling or embossing the outer shell.

14. The method of claim 8 further comprising joining a cover having a pen clip to one end of the smoking device.

* * * * *